US009849068B2

(12) United States Patent
Martin

(10) Patent No.: US 9,849,068 B2
(45) Date of Patent: Dec. 26, 2017

(54) PILL SPLITTING APPARATUS

(71) Applicant: Francois Martin, Houston, TX (US)

(72) Inventor: Francois Martin, Houston, TX (US)

( * ) Notice: Subject to any disclaimer, the term of this patent is extended or adjusted under 35 U.S.C. 154(b) by 326 days.

(21) Appl. No.: 14/745,621

(22) Filed: Jun. 22, 2015

(65) Prior Publication Data

US 2016/0367441 A1 Dec. 22, 2016

(51) Int. Cl.
*B26F 3/00* (2006.01)
*A61J 7/00* (2006.01)

(52) U.S. Cl.
CPC ..... *A61J 7/0007* (2013.01); *B26F 3/00* (2013.01)

(58) Field of Classification Search
CPC ..... A61J 7/0007; B26F 3/00
USPC ..... 225/1, 6, 93, 99, 100
See application file for complete search history.

(56) References Cited

U.S. PATENT DOCUMENTS 2,655,259 A * 10/1953 Davoren ..... A61J 7/0007 206/38
3,517,871 A * 6/1970 Gaffney ..... A61J 7/0007 206/530
4,199,863 A * 4/1980 Deckert ..... A61J 7/0007 30/124
4,422,553 A 12/1983 Hoeks et al.
4,473,192 A * 9/1984 Urban ..... A61J 7/0007 225/103
4,903,877 A * 2/1990 Hnatuk ..... A61J 7/0007 225/93
4,964,555 A * 10/1990 Hnatuk ..... A61J 7/0007 225/103
5,118,021 A 6/1992 Fiocchi
5,944,243 A 8/1999 Weinstein
6,050,064 A * 4/2000 Yuyama ..... B26D 3/30 53/154
6,474,525 B1 * 11/2002 Reitano ..... A61J 7/0007 225/1
6,527,155 B2 * 3/2003 Buckley ..... A61J 7/0007 225/1
6,557,945 B1 * 5/2003 Eric ..... A61J 7/0007 30/124
6,601,746 B2 8/2003 Buckley et al.
6,739,488 B1 * 5/2004 Sharpe ..... B26D 3/30 225/104
6,968,987 B1 * 11/2005 Reitano ..... A61J 7/0007 225/1

(Continued)

*Primary Examiner* — Sean Michalski
(74) *Attorney, Agent, or Firm* — Dale J. Ream

(57) ABSTRACT

A pill, or like object, splitting apparatus includes a base having a bottom and continuous side walls defining an interior area. The side wall defines primary apertures. A cutting platform is situated in the interior area in a first horizontal plane defined by apertures, the cutting platform defining a bore extending horizontally between the primary apertures. Primary clamp members extends through respective primary apertures into the bore of the cutting platform. The clamp members engage with the pill to position and hold the pill/tablet stable during the cutting process. A plunger assembly having a compression plate and a blade is operatively coupled to the compression plate, the plunger selectively positioned in communication with the interior area via the open top of the base such that the blade severs the pill upon a downward pressure on the compression plate. The cutting portion is interchangeable with different configurations of blade/blades.

22 Claims, 12 Drawing Sheets

(56) References Cited

U.S. PATENT DOCUMENTS 7,275,671 B1 * 10/2007 Reitano ..... A61J 7/0007 225/23
7,458,300 B2 12/2008 Williams
7,828,181 B1 * 11/2010 Reitano ..... B26D 3/30 225/1
8,430,287 B2 * 4/2013 Sze ..... A61J 7/0007 225/1
8,973,800 B2 * 3/2015 Liu ..... B67B 7/92 225/103
2002/0084300 A1 * 7/2002 Elkins ..... B26F 3/002 225/1
2002/0179669 A1 * 12/2002 Buckley ..... B65H 35/10 225/4
2003/0019900 A1 * 1/2003 Dienst ..... A61J 7/0007 225/104
2005/0067452 A1 * 3/2005 Darst ..... A61J 7/0007 225/103
2007/0164141 A1 * 7/2007 Engel ..... A61J 7/0007 241/169.2
2008/0011804 A1 * 1/2008 Petrie ..... A61J 7/0007 225/103
2008/0223893 A1 * 9/2008 Petrie ..... A61J 7/0007 225/39
2009/0183373 A1 * 7/2009 Suhr ..... A61J 7/0007 30/124
2012/0060374 A1 * 3/2012 Noble ..... A61J 7/0007 30/124
2012/0187229 A1 * 7/2012 Clouser ..... B02C 1/04 241/30
2013/0056511 A1 * 3/2013 Lundgren ..... A61J 7/0007 225/103
2014/0021276 A1 * 1/2014 Young ..... B02C 19/08 241/25
2014/0311304 A1 * 10/2014 Noble ..... A61J 7/0007 83/13
2016/0051448 A1 * 2/2016 Ferraro ..... A61J 7/0007 83/468.7
2016/0310366 A1 * 10/2016 Evans ..... A61J 7/0023
2016/0367441 A1 * 12/2016 Martin ..... A61J 7/0007

* cited by examiner

PILL SPLITTING APPARATUS

BACKGROUND OF THE INVENTION

This invention relates generally to medication preparation and delivery devices and, more particularly, to a pill splitting apparatus having two or more moveable/dynamic clamping members that serve to position a pill/tablet or similar object into a desired position and that serve to hold the pill/tablet of any size and shape while a plunger assembly having one or more blades is firmly actuated so as to sever the pill into a predetermined number of pieces of uniform size.

Caregivers such as nurses in facilities such as hospitals and nursing homes often have need to split a pill into two halves, four quarters, or the like in that the patient may be found to tolerate smaller doses at a time. This would especially be necessary if the medication is not manufactured in the fractional dosage or is simply not immediately available.

Pill splitting devices are generally known for cutting pill-form medications into pieces by forcing a blade downwardly against a pill. Although presumably effective for their general purposes, the existing devices and proposals sometimes result in pieces that are not severed uniformly or completely in that the pill is not held securely in position and in that the pill is not accurately positioned so the pills center coincide with the center of the cutting blade/blades.

Therefore, it would be desirable to have a pill splitting apparatus having two or more moveable/dynamic clamping members that are manually or automatically urged together to hold a pill in a centered and stable position prior to being severed. In addition, it would be desirable to have a pill splitting apparatus having a plunger assembly with interchangeable cutting portions that may be actuated to split a pill into predetermined uniformed pieces, and to give the user the option to replace the cutting portion with a newer one once the blade/blades are worn out.

SUMMARY OF THE INVENTION

A splitting apparatus for cutting a pill or like object into multiple uniformly-sized pieces according to the present invention includes a base having a bottom wall and a continuous side wall extending upwardly from the bottom wall so as to define an interior area and an open top. The side wall defines a pair of primary apertures opposed from one another and forming a primary horizontal axis. A cutting platform is situated in the interior area in a first horizontal plane defined by the pair of primary apertures, the cutting platform defining a bore extending horizontally between and aligned with the primary apertures. A center section of the cutting platform where the pill or object is selectively received and positioned is referred to as the pill tray.

Two or more clamping members (e.g. at least a pair of clamping members) selectively extend through respective primary apertures a selected distance into the interior area, the support clamp members slidably received into the bore of the cutting platform and selectively bear against the pill tray. The clamp members selectively position and hold the pill at a desired position or at a centered position using a plurality of spaced apart measurement indicia on the pill tray that is located at the center of the cutting platform. A plunger assembly having a compression plate and at least one blade is operatively coupled to a bottom side of the compression plate, the plunger selectively positioned in communication with the interior area via the open top of the base such that the at least one blade severs the pill upon a downward pressure on the compression plate.

Therefore, a general object of this invention is to provide a pill splitting apparatus for holding a pill in a stable, centered position, where the center point of the pill coincides with the center point of the blade/blades while being severed into predetermined uniformly-sized portions.

Another object of this invention is to provide a pill splitting apparatus, as aforesaid, having two or more clamp members that are manually or automatically urged together to clamp a pill/tablet in place for a cutting action.

Another object of this invention is to provide a pill splitting apparatus, as aforesaid, having corresponding clamp members that are urged together automatically using a spring or the like so the clamp members can uniformly adjust their position while blades are cutting through the pill and that helps prevent the pill from getting crushed during the cutting, hence resulting in a smoother cut and uniformly sized pieces.

Yet another object of this invention is to provide a pill splitting apparatus, as aforesaid, that can process and split all the sizes of the round shaped pills/tablets into 2, 4, 6, and 8 uniformly-sized pieces.

Yet another object of this invention is to provide a pill splitting apparatus, as aforesaid, that can process and split all the sizes of the oval shaped pills/tablets into 2 or 4 uniformly-sized pieces.

Yet another object of this invention is to provide a pill splitting apparatus, as aforesaid, that can process and split all sizes of any shaped pills/tablets, such as triangle shaped pills, into two uniformly-sized pieces.

Yet another object of this invention is to provide a pill splitting apparatus, as aforesaid, having a plunger assembly that includes a cutting portion that may be selectively interchanged with another cutting portion having a different blade pattern.

Yet another object of this invention is to provide a pill splitting apparatus, as aforesaid, having a plunger assembly that includes a cutting portion that may be selectively interchanged with a new cutting portion that has new blades that can be purchased separately, once the blades are worn out.

A further object of this invention is to provide a pill splitting apparatus, as aforesaid, in which the cutting portion is coupled to a compression portion in a friction fit arrangement that is both secure and easy to separate, such as for interchanging with another cutting portion.

A still further object of this invention is to provide a pill splitting apparatus, as aforesaid, that is safe, easy to use, and inexpensive to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
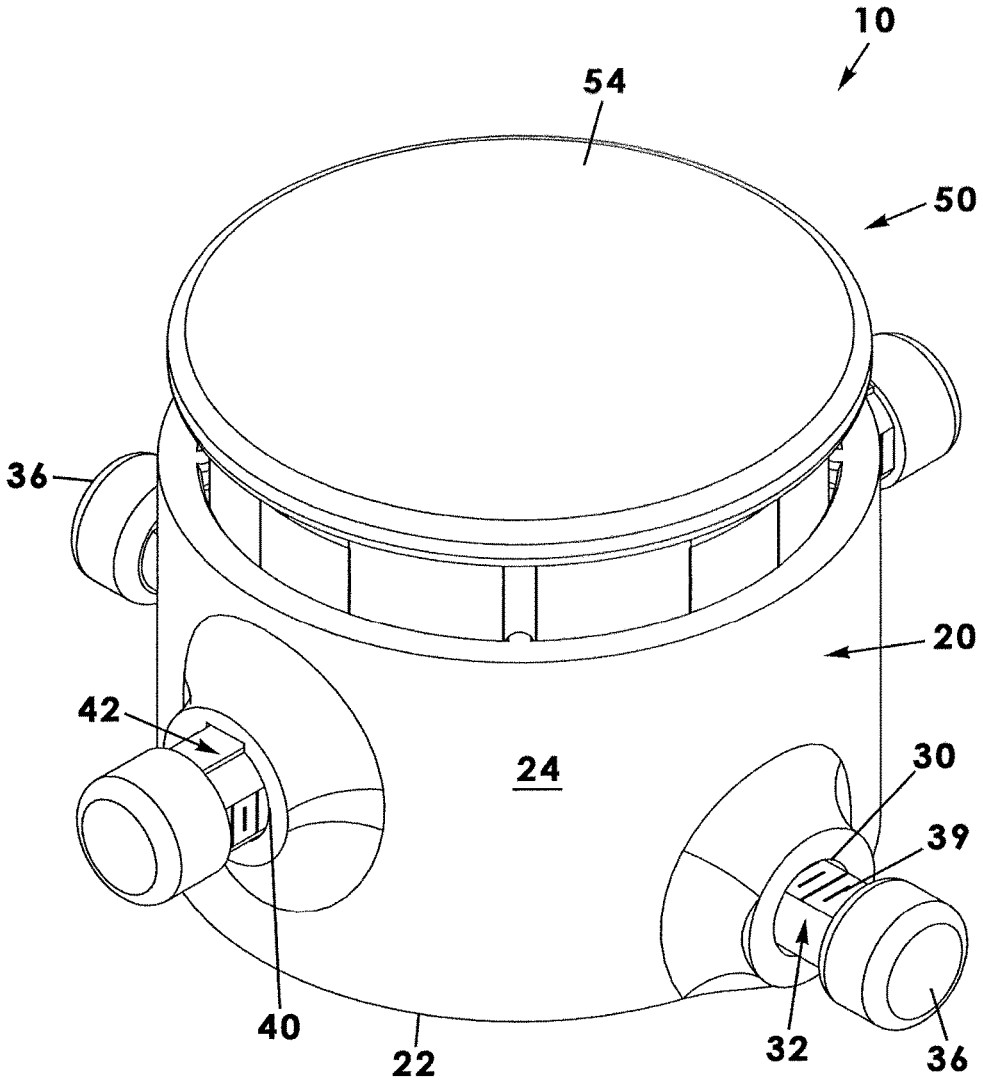
FIG. 1 is a perspective view of a pill splitting apparatus according to a preferred embodiment of the present invention.
Figure 2:
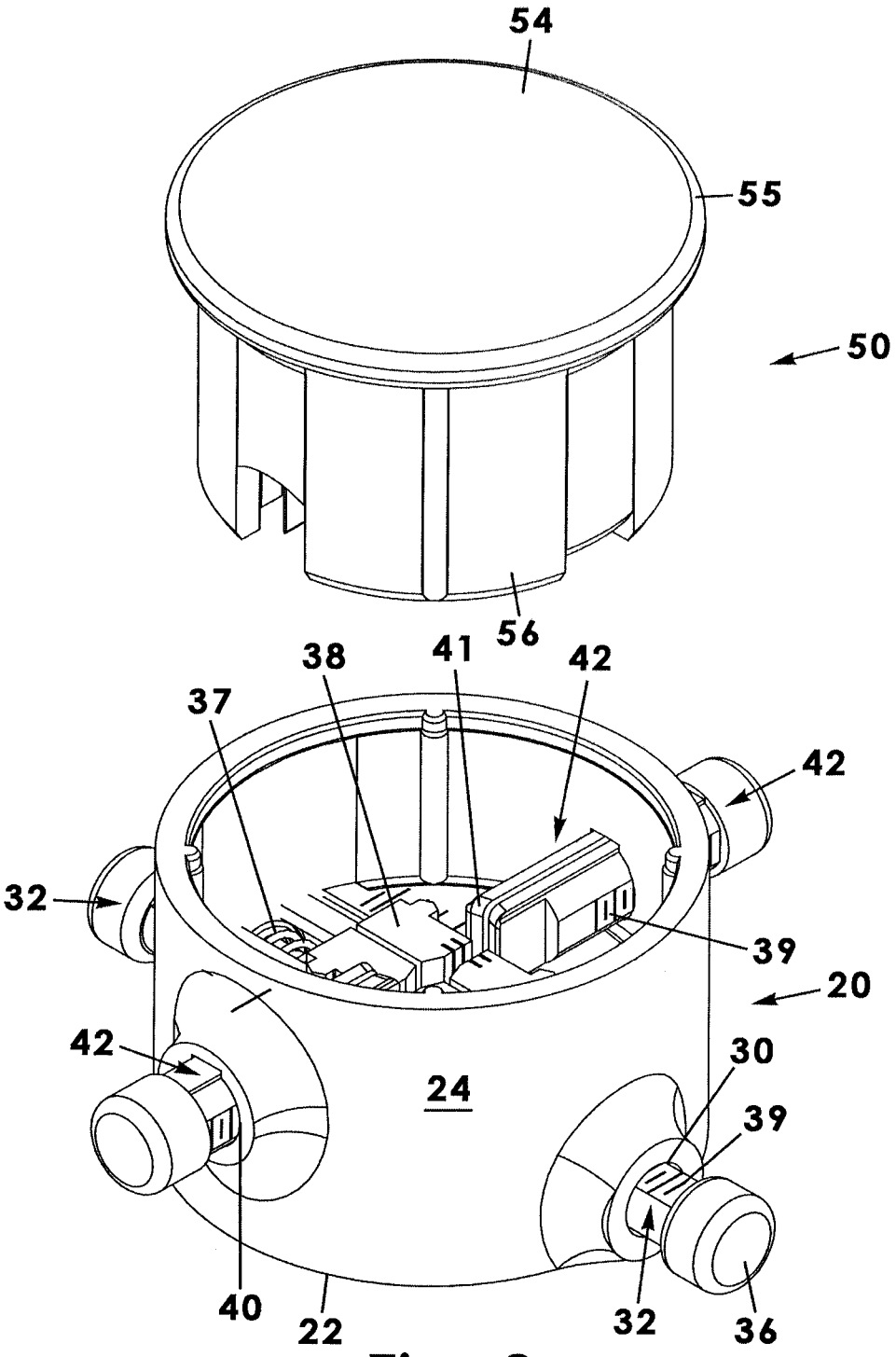
FIG. 2 is an exploded view of the pill splitting apparatus as in FIG. 1.

A pill splitting apparatus according to a preferred embodiment of the present invention will now be described with reference to FIGS. 1 to 12*d* of the accompanying drawings. The pill splitting apparatus 10 includes a base 20, a pair of primary clamp members 32, a cutting platform 44, and a plunger assembly 50 having a compression portion 52 and cutting portion 60.

Figure 3:
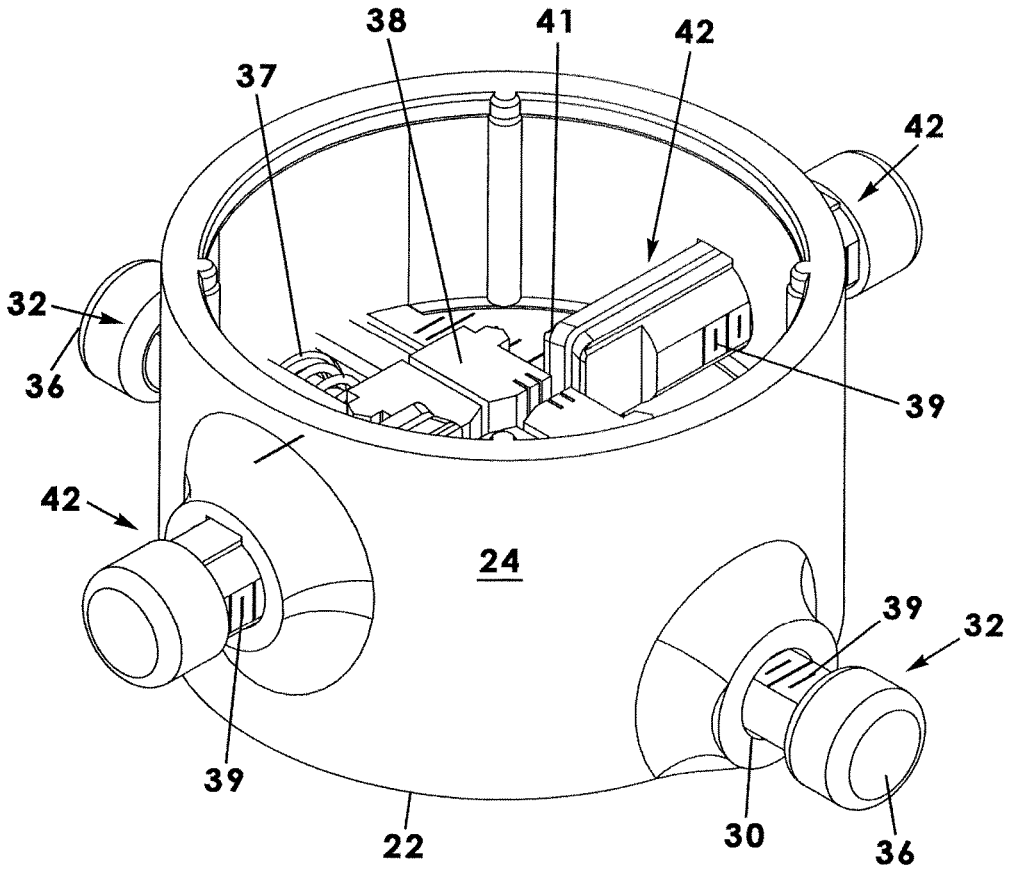
FIG. 3 is an isolated perspective view of a base of the pill splitting apparatus.
Figure 4A:
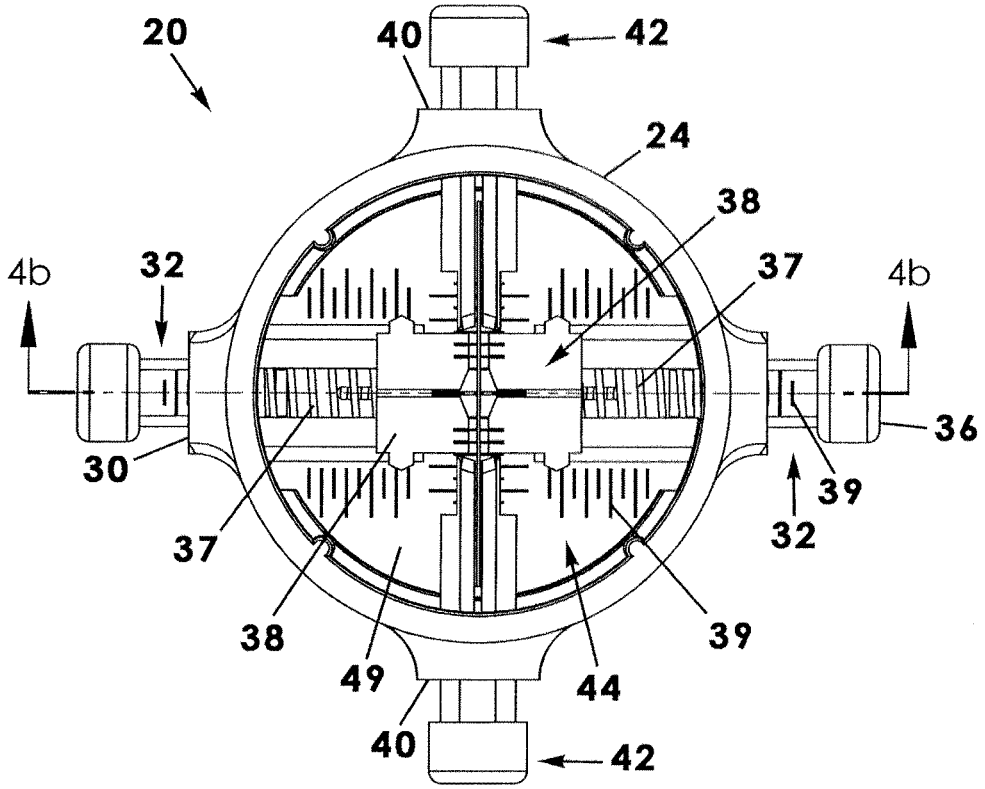
FIG. 4*a* is a top view of the base as in FIG. 3.
Figure 4B:
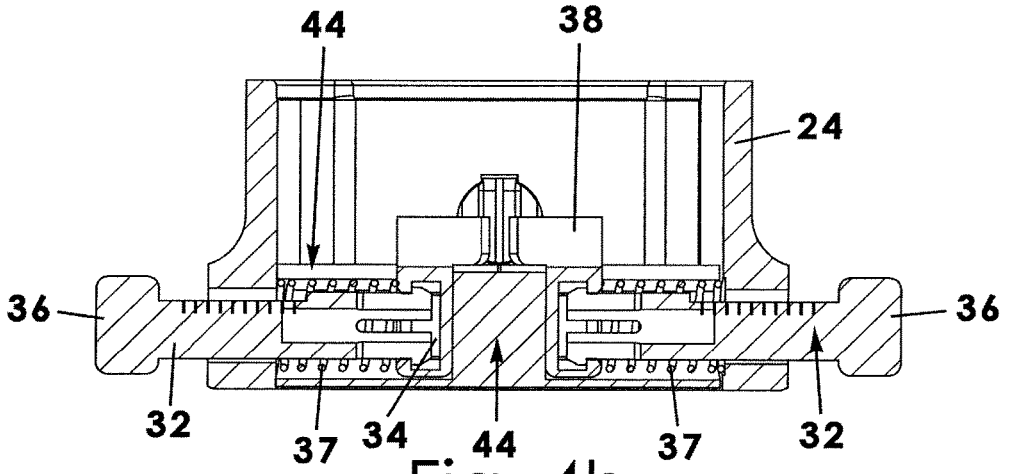
FIG. 4*b* is a sectional view of the base taken along line 4*b*-4*b* of FIG. 4*a;*

The base 20 includes a bottom wall 22 and a continuous side wall 22 extending upwardly from a peripheral edge of the bottom wall 22. The bottom wall 22 and continuous side wall 24, together, form a generally cylindrical housing defining an interior area accessible through an open top (FIG. 3). The side wall 24 defines a pair of oppositely disposed primary apertures 30 that, together, define an imaginary primary horizontal axis. In an embodiment, the side wall 24 may define a pair of oppositely disposed secondary apertures 40 that, together, define an imaginary secondary horizontal axis. It is noted that the pair of primary apertures 30 are situated lower on the side wall 24 than the pair of secondary apertures 40 for reasons that will become apparent later. The primary horizontal axis is perpendicular to the secondary horizontal axis for effectively positioning a pill, as will also be described in more detail later. Each horizontal axis is part of a respective horizontal plane.

Figure 5:
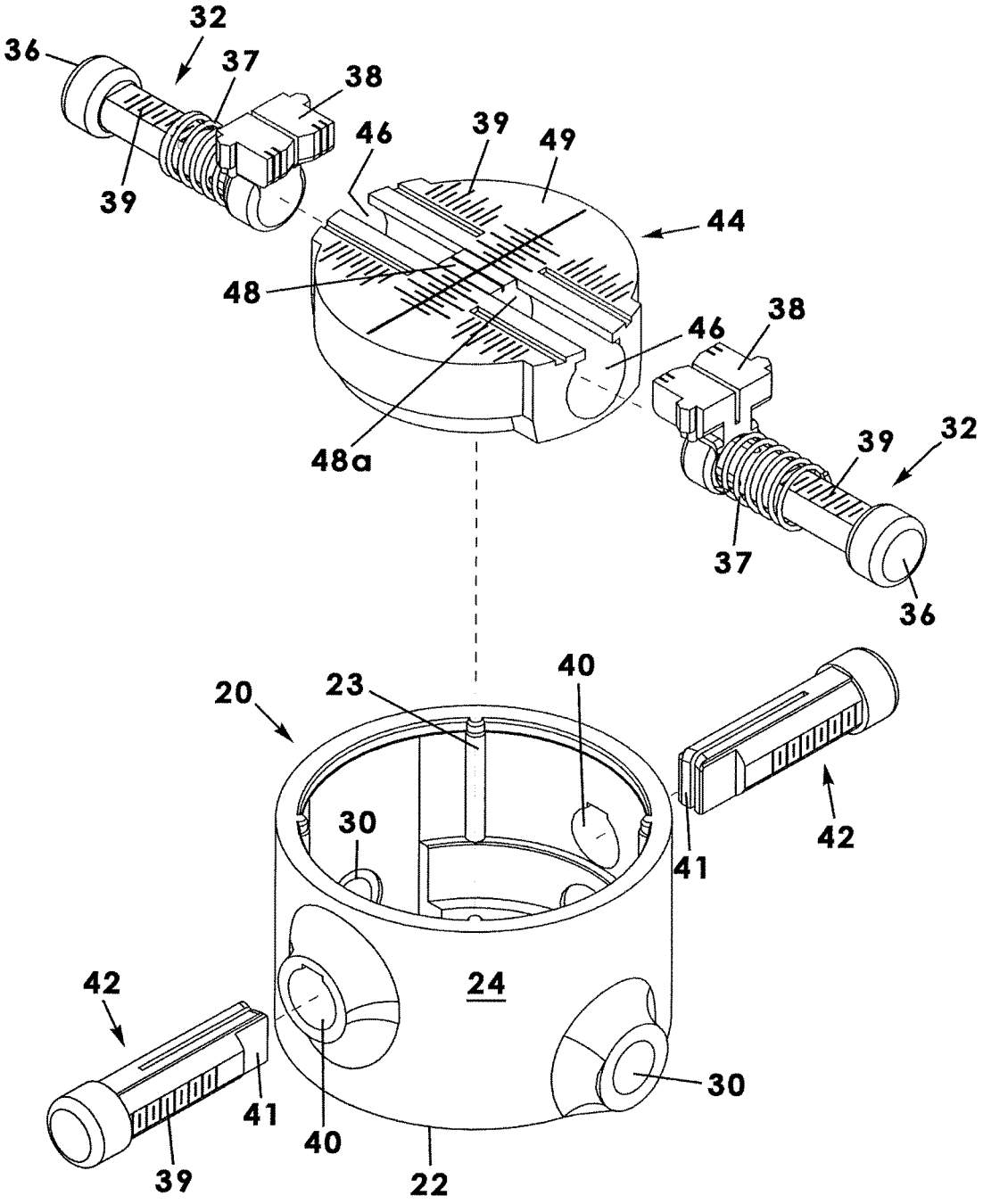
FIG. 5 is an exploded view of the base as in FIG. 3.
Figure 6:
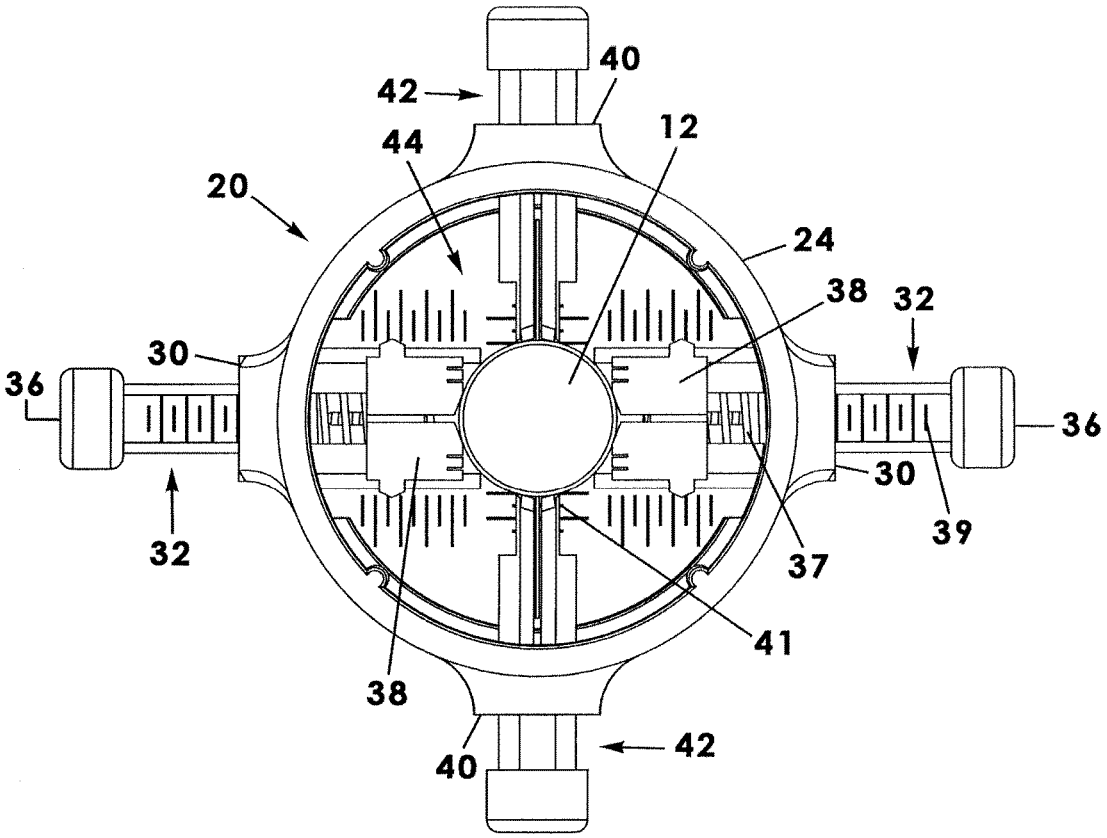
FIG. 6 is another top view of the base as in FIG. 3 illustrated in use with a pill.

The pill splitting apparatus 10 includes a pill cutting platform 44 (also referred to simply as the "cutting platform"). The cutting platform 44 has a generally circular configuration substantially similar to the size and shape of an inner surface of the base 20. The cutting platform 44 is situated within the interior area of the base 20 proximate the primary apertures 30. More particularly, the cutting platform 44 defines a bore 46 extending horizontally between its opposed side walls and defining an open top side the entire length of the bore 46 (FIG. 5). The cutting platform 44 is positioned in the interior area of the base 20 such that the bore 46 is in communication with respective primary apertures 30. Further, the center section of the cutting platform is referred to as a pill tray 48 and includes a body member 48*a* extended downwardly into bore 46.

In an embodiment, the pill splitting apparatus 10 includes at least a pair of primary clamp members 32 extending through respective primary apertures 30 (FIG. 1) and into the bore 46 of the cutting platform 44 from opposed directions (FIG. 5). It is understood that some embodiments of the invention may include a plurality of corresponding clamp members—even an odd number of clamp members positioned in more than just opposing directions. Therefore, references to "a pair of primary" or "a pair of secondary" clamp members should be understood to include many more clamp members.

Each primary clamp member 32 has a generally linear rod-shaped configuration with a circular end cap configured to slide in the bore 46. The end cap at respective proximal ends 34 of respective primary clamp members 32 may be coupled to the engagement members 38 in a friction or snap-fit arrangement when it is sufficiently inserted into bore 46. Accordingly, the engagement members 38 may be selectively moved back and forth along the bore 46 according to insertion of respective primary clamp members 32.

Figure 7A:
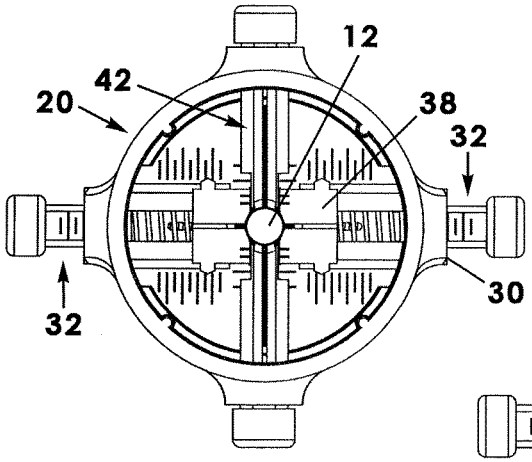
FIGS. 7*a* to 7*d* are top views of the base as in FIG. 6 illustrating use with pills of various sizes and configurations.
Figure 7B:
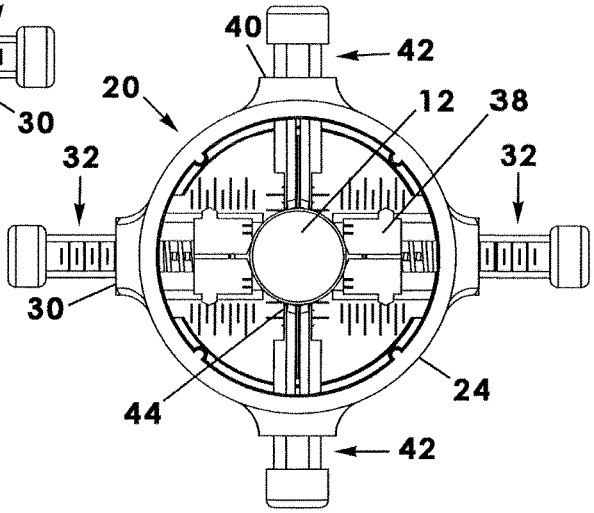
Figure 7C:
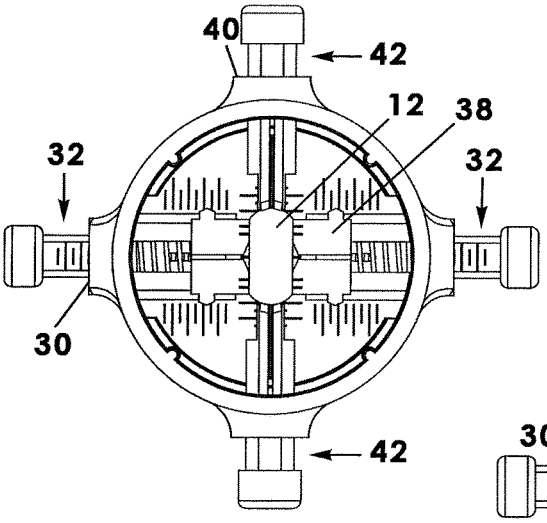
Figure 7D:
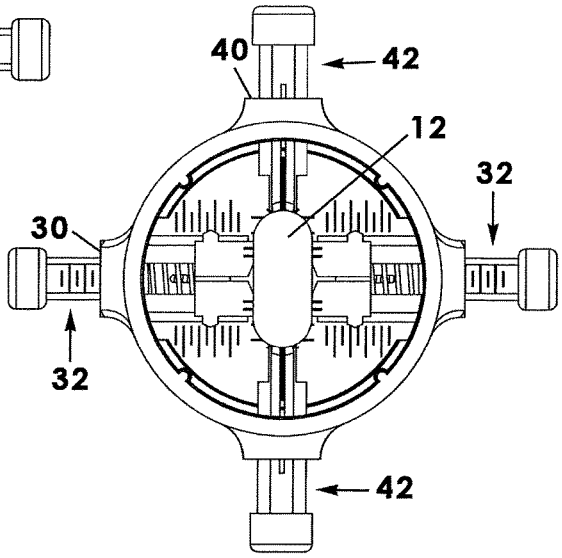
Figure 8:
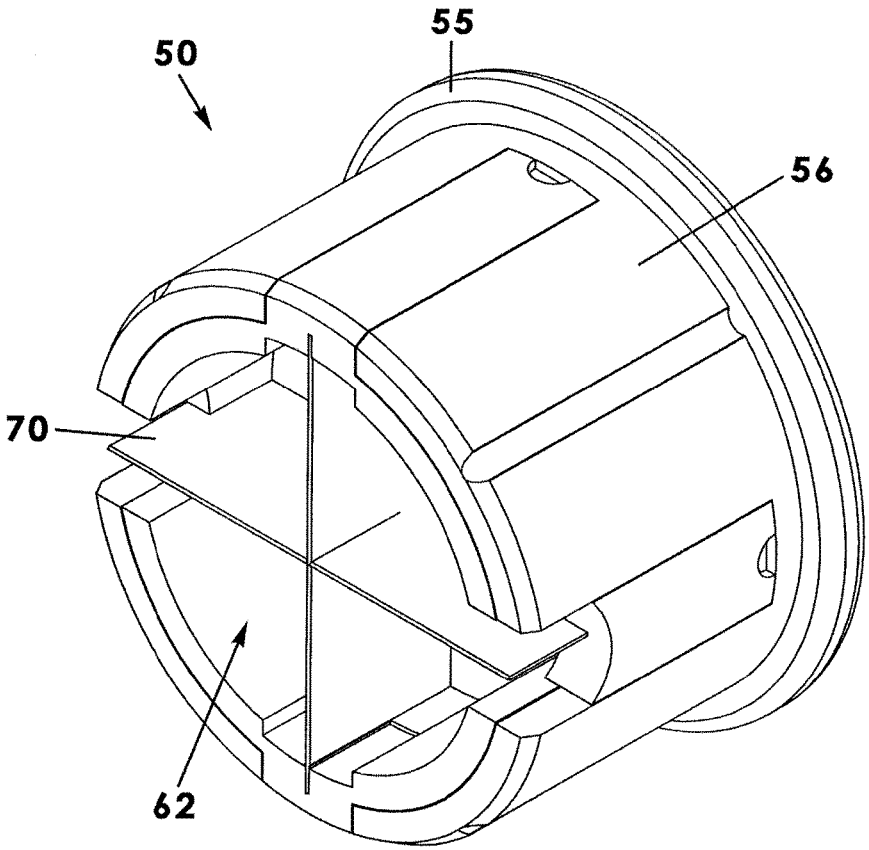
FIG. 8 is a perspective view of the plunger assembly of the pill splitting apparatus as in FIG. 2.

Therefore, each primary clamp member 32 includes an engagement member 38 that is snap fit into proximal end 34 positioned in the bore 46 of the cutting platform 44 and an opposed distal end 36 situated outside the interior area altogether (FIG. 5). Further, each engagement member 38 may be configured to bear against a pill when a pill is supported atop the pill tray 48. In fact, forward edges of the at least one engagement member 38 may include a recess, depression, or curved surface so as to better engage the side of a pill as best shown in FIGS. 7*a* and 7*b* although pills of many configurations will also be held effectively (FIGS. 7*c* and 7*d*).

Each primary clamp member 32 includes a biasing member 37 configured to normally urge the primary clamp member 32 toward the pill tray 48 and support pill 12 thereon. More particularly, the biasing member 37 may be a compression spring having one end coupled to an inner surface of the continuous side wall 22 of the base 20 and another end coupled to engagement member 38 (FIG. 5). A respective biasing member 37 is preferably positioned to envelop the primary clamp member 32. The biasing member 37 has a diameter larger than that of a respective primary aperture 30 such that it is always captive to the interior area of the base 20 even when a primary clamp member 32 moves a distance outside of the interior area. In use, a user may pull on the distal ends 36 of the pair of primary clamp members 32, causing the biasing members 37 to compress and the pill 12 to be released from the vice-like pressure. Upon release of the outward pulling force, however, causes the biasing members 37 to again urge corresponding primary clamp members 32 and engagement members 38 toward the pill 12, respectively.

In an embodiment, the primary clamp members 32 may be held in a clamping relationship relative to the pill tray 48 in another manner (i.e. other than with biasing members 37). In this embodiment (not shown), each primary aperture 30 may include a threaded surface and each primary clamp member has proximal end having a threaded bolt-like configuration.

The threaded configuration allows each clamping member to be incrementally threaded into a clamping configuration bearing against the pill tray 48 and, therefore, to constantly maintain a tight engagement in a manner similar to the embodiment described above having a spring biased configuration.

In an embodiment, the primary clamp members 32 may be held in a clamping relationship relative to the pill tray 48 in another manner (i.e. other than with biasing members 37). In this embodiment (not shown), the clamp members can position and center the pill using a gear mechanism that is controlled by a single knob. Clockwise rotation of the knob causes all the clamp members to retract which allows the user to place the pill in between. Once the knob has been released, the clamp members automatically place and hold the pill at a centered position where the center of the pill coincides with the center of the cutting blade/blades.

Each primary clamp member 32 includes a surface (such as a flattened surface), having a plurality of measurement indicia 39 imprinted or engraved thereon. Similarly, an upper surface 49 of the cutting platform 44 maybe include a plurality of the measurement indicia thereon (FIG. 5). The measurement indicia 39 may be indicative of the size of pill being clamped atop the pill tray 48 and, correspondingly how far the primary clamp members 32 are to be inserted into the base 20. In practical use, the measurement indicia 39 enable a nurse or caregiver to properly position the pill at a centered position before compressing the plunger assembly 50 to split the pill, as will be described in greater detail later.

Similarly, the continuous side wall 22 of the base 20 may define a pair of secondary apertures 40 opposed from one another and that, together, define an imaginary secondary horizontal axis. As indicated above, the secondary horizontal axis is above the horizontal axis and is in a horizontal plane defined by the pair of secondary apertures 40. The pill splitting apparatus 10 includes a pair of secondary clamp members 42 extending through respective secondary apertures 40 and into the interior area of the base 20 (FIG. 1). Each secondary clamp member 42 includes a first end 41 configured to bear against an end of a pill when a pill is, in fact, positioned atop the pill tray 48 as described above. Clamp members 42 help to accurately center the pill, so that the center of the pill is aligned with the center of cutting blade/blades. Together, the pair of secondary clamp members 42 cooperate to hold a pill in position before and during an operation of the plunger assembly 50. Each secondary clamp member 42 may include a plurality of measurement indicia 39 that, as described previously, may aid a user in confirming that a pill is properly positioned and centered prior to a splitting action.

Figure 9:
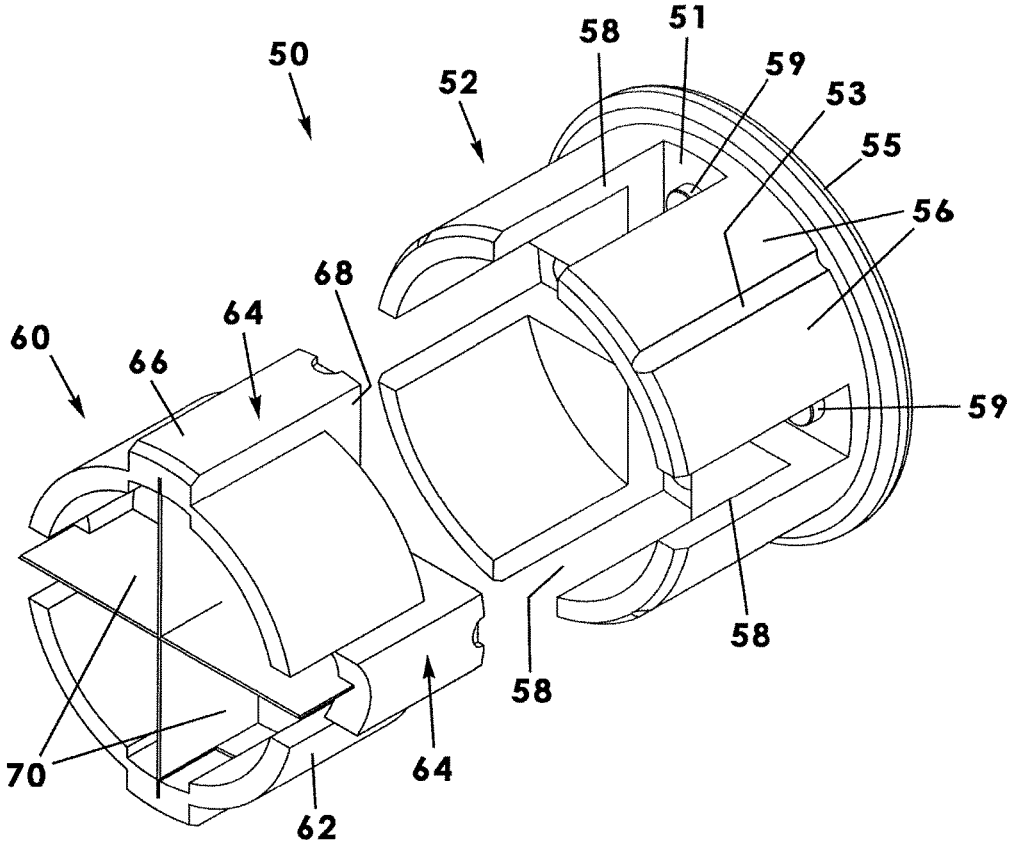
FIG. 9 is an exploded view of the plunger assembly as in FIG. 8.

In another aspect of the invention, the plunger assembly 50 is configured to be thrust vigorously and downwardly into the interior area of the base 20 so as to split a pill. More particularly, the plunger assembly 50 includes a compression portion 52 and a cutting portion 60 removably coupled to the compression portion 52 and having at least one blade 70. The compression portion 52 includes a compression plate 54 and a side wall 56 extending downwardly from the compression plate 54 in a manner that, together, defines an open interior space and an open bottom providing access to the interior space (FIG. 9). In an embodiment, the compression plate 54 has a planar surface although a convex, domed, or other configuration would also work. In an embodiment, a peripheral edge of the compression plate may have a diameter that is larger than a diameter of the side wall 56 depending therefrom as well as the continuous side wall 22 of the base 20 so as to form a ledge 55 to make it easier for the user to hold the plunger assembly in order to insert it in or pull it out.

The side wall 56 of the compression portion 52 defines at least one cutout 58—a void in communication with the open bottom. The cutout 58 extends from the open bottom toward surface body 51 that is a lower surface of the compression plate 54. Preferably, the side wall 56 of the compression portion 52 defines a plurality of spaced apart cutouts 58, each cutout 58 to be used in coupling the cutting and compression portions.

The cutting portion 60 of the plunger assembly 50 includes a framework 62 that is removably coupled to the compression portion 52. More particularly, the framework 62 includes a least one flange 64 having a configuration complementary to at least one cutout 58 such that the cutting portion 60 may be slidably coupled to the compression portion 52, such as in a friction fit engagement. Accordingly, the cutting portion 60 may be selectively removed by a user from the compression portion 52 or even interchanged with another cutting portion 60 as will be discussed later. In an embodiment in which the side wall 56 defines a plurality of cutouts 58, the framework 62 includes a plurality of flanges 64 configured to selectively couple with respective cutouts 58.

Figure 10B:
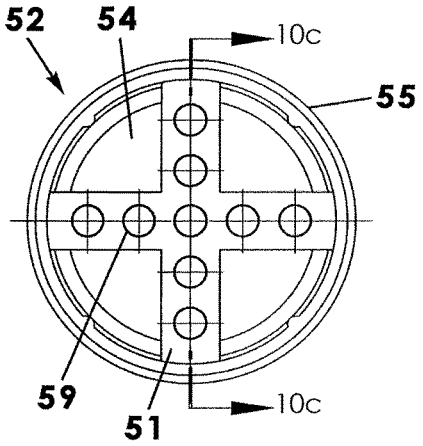
FIG. 10*b* is bottom view of the compression portion as in FIG. 10*a;*
Figure 10C:
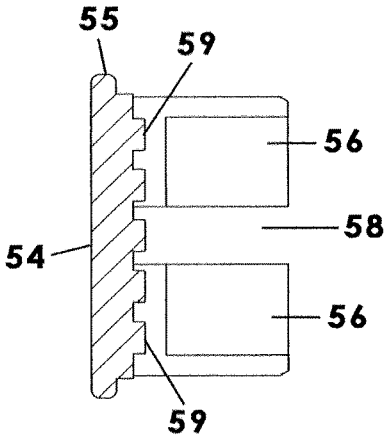
FIG. 10*c* is a sectional view of the compression portion taken along line 10*c*-10*b* of FIG. 10*b;*
Figure 10D:
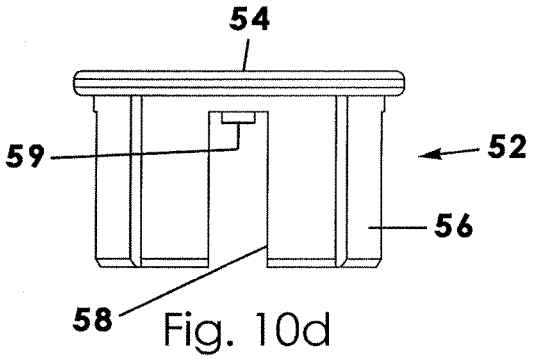
FIG. 10*d* is a side view of the compression portion as in FIG. 10*a;*
Figure 10A:
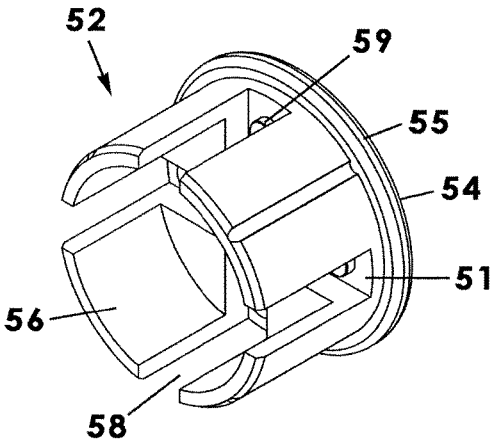
FIG. 10*a* is an isolated perspective view of a compression portion as in FIG. 9.
Figure 10E:
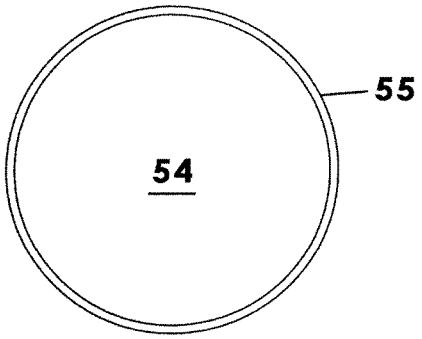
FIG. 10*e* is a top view of the compression portion as in FIG. 10*a;*
Figure 11B:
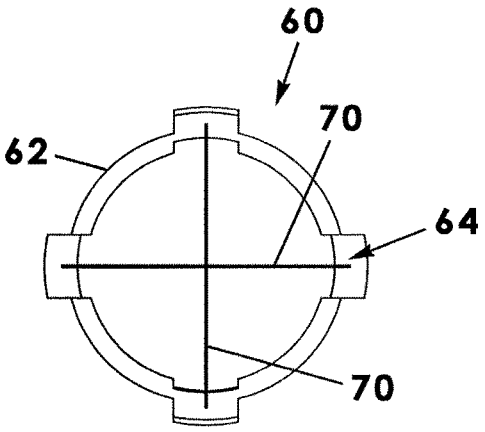
FIG. 11*b* is bottom view of the cutting portion as in FIG. 11*a;*
Figure 11A:
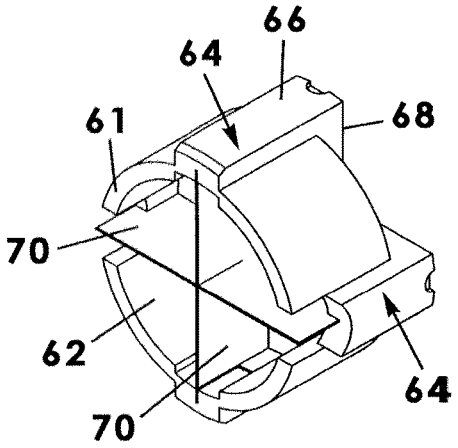
FIG. 11*a* is an isolated perspective view of the cutting portion as in FIG. 9.
Figure 11C:
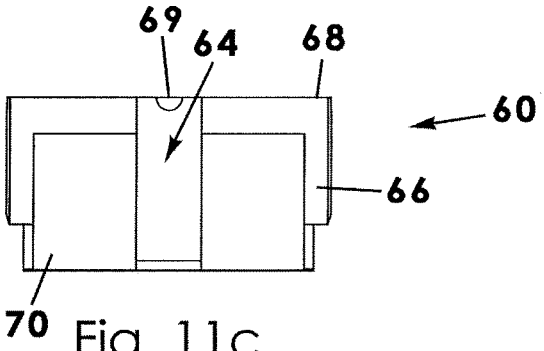
FIG. 11*c* is a side view of the cutting portion as in FIG. 11*a;*
Figure 11D:
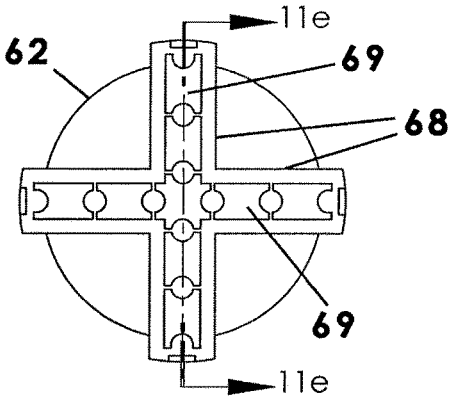
FIG. 11*d* is a top view of the cutting portion as in FIG. 11*a;*
Figure 11E:
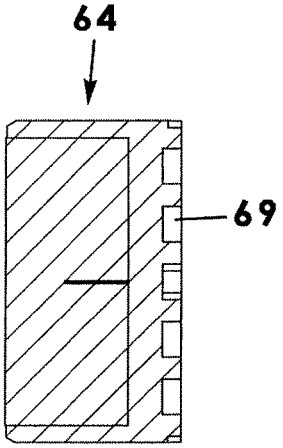
FIG. 11*e* is a sectional view taken along line 11*e*-11*e* of FIG. 11*d.

In addition, a plurality of nubs 59 may be spaced apart along a surface body 51 which is a lower surface of the compression plate 54 (FIGS. 9, 10, and 10*b*). More particularly, each flange 64 includes an L-shaped configuration having a side section 66 selectively mating with a respective cutout 58 and a top section 68 defining a plurality of recesses 69 (FIG. 11*d*) configured to matingly receive corresponding nubs 59 in a friction fit and selectively removable arrangement. The cutting portion 60 is situated within the interior space defined by the side wall 56 of the compression portion 52 of the plunger assembly 50 when the framework 62 is coupled to cutouts 58 and nubs 59 as described above.

Figure 12A:
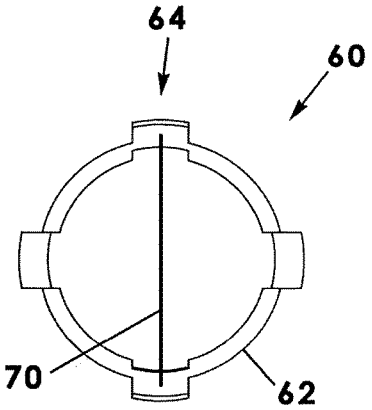
* and FIGS. 12*a* to 12*d* are bottom views of cutting portions having various cutting blade quantities and patterns.
Figure 12B:
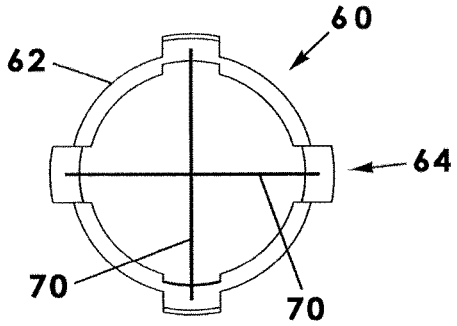
Figure 12C:
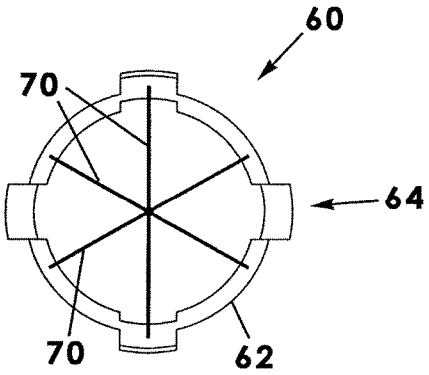
Figure 12D:
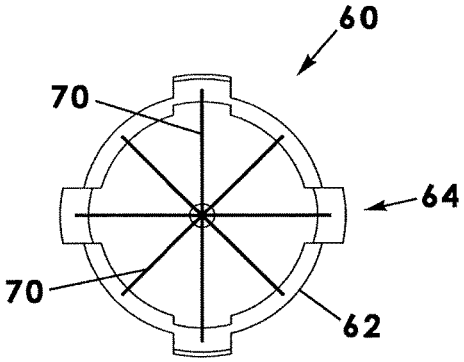

One or more cutting blades 70 are coupled to a lower extent of the framework 62, such extending between opposed flanges 64 or opposed walls (FIGS. 12*a* to 12*d*). It is understood that the pill splitting apparatus 10 described above may include a plurality of cutting portions 60 that have similar configurations such that one cutting portion may be interchangeably connected to the compression portion 52. For instance, various cutting portions 60 may include different numbers of cutting blades, i.e. to cut a pill into two or more sections (FIG. 12*a*). More particularly, the "at least one blade" described above may, in some cutting portions 60, actually include two blades arranged in a crisscross pattern so as to split a pill held on the pill tray 48 into four portions upon operation of the plunger assembly 50 (FIG. 12*b*). Similarly, another cutting portion 60 may include three blades arranged in a spaced apart pattern so as to split a pill held on the pill tray 48 into six portions upon operation of the plunger assembly 50 (FIG. 12*c*). Or, four blades would split a pill into eight portions (FIG. 12*d*). It is understood that a user of the pill splitting apparatus 10 may be a hospital, nursing, or other health care provider and may desire access to multiple cutting portions 60 having different blade patterns so as to split medications as needed. The cutting portions 60 may be quickly interchanged as described above.

In addition, once the blades are worn out, users can purchase a new cutting portion having new blades that can be quickly interchanged as described above.

In use, the plunger assembly 50 is removed from the base 20 when use of the pill splitting apparatus 10 is desired so that a pill may be positioned atop the pill tray 48. The pair of primary clamp members 32 may need to be momentarily urged outwardly so that the engagement members 38 provide enough space for pill placing and positioning. Upon release, the pair of primary clamp members 32 are automatically urged by respective biasing members 37 toward the pill tray 48 and the engagement members 38 toward the pill itself. Using the plurality of spaced apart measurement indicia, users adjust the clamp members in order to position the pill/tablet accurately into the desired position. In this case, position the center of the pill in the center of the pill splitting apparatus, so it coincides with the center of the cutting blades. Then, the secondary clamp members 42 may be inserted through respective secondary apertures 40 so they can be used to make it easier to accurately position the pill into the desired position (such as in the center) and to add more clamping force on the pill Hence, the pill is more stable during the cutting process. The primary and secondary clamp members, therefore, clamp and position the pill from four directions so as to hold it still during a pill splitting action. The plunger assembly 50 may then be inserted into the interior area of the base 20 so that the blade or blades will sever the pill into a desired number of pieces.

The plunger assembly 50 is aligned with the base 20, with the help of the grooves 53 on the outer side of the compression portion 52, and the alignment keys 23 that are on the inner sides of the base 20.

It is understood that while certain forms of this invention have been illustrated and described, it is not limited thereto except insofar as such limitations are included in the following claims and allowable functional equivalents thereof.

The invention claimed is:

1. A pill splitting apparatus for cutting a pill or like object into multiple pieces, comprising:

a base having a bottom wall and a continuous side wall extending upwardly from said bottom wall so as to define an interior area and an open top;

wherein said side wall defines a pair of primary apertures opposed from one another and forming a primary horizontal axis;

a cutting platform situated in said interior area situated in a first horizontal plane defined by said pair of primary apertures, said cutting platform defining a bore extending horizontally between and aligned with said primary apertures;

wherein said cutting platform includes a pill tray located at a center of said cutting platform and having one of a flat or beveled configuration for selectively receiving the pill;

a pair of primary clamp members selectively extending through respective primary apertures a selected distance into said interior area, said pair of primary support clamp members slidably received into said bore of said cutting platform and selectively bearing against the pill so as to selectively position the pill along said bore;

a plunger assembly having a compression plate and at least one blade operatively coupled to a bottom side of said compression plate, said plunger selectively positioned in communication with said interior area via said open top of said base such that said at least one blade severs the pill upon a downward pressure on said compression plate.

2. The pill splitting apparatus as in claim 1, wherein a respective primary clamp member comprises:

a proximal end positioned in said bore of said cutting platform of said base proximate said pill tray and an opposed distal end positioned outside of said interior area;

at least one engagement member is extended from the center of the bore into the top of the cutting platform selectively bearing against the pill when the pill is supported atop said pill tray.

3. The pill splitting apparatus as in claim 2, wherein said respective primary clamp member includes:

a biasing member having one end coupled to an inner surface of said side wall of said base member adjacent a respective primary aperture and another end coupled to said proximal end of said respective primary clamp member, said biasing member configured to normally urge said respective primary clamp member toward said pill tray; and wherein said biasing member includes a diameter larger than a diameter of a respective primary aperture;

whereby said primary clamp members are normally urged inwardly to hold the pill securely atop said pill tray.

4. The pill splitting apparatus as in claim 3, wherein:

said pair of primary clamp members is biased to normally bear against said pill tray from opposing directions and to urge respective engagement members toward the pill from opposing directions;

said biasing member is a compression spring; and respective outward movements of respective primary clamp members causes respective biasing members to compress against an inner surface of said side wall of said base member and to release said pill tray.

5. The pill splitting apparatus as in claim 2, wherein said respective primary clamp members are adjustable so as to process any pill size and any pill shape.

6. The pill splitting apparatus as in claim 2, wherein each respective primary clamp member includes a surface having a plurality of spaced apart measurement indicia for accurately positioning the pill being held securely between said pair of primary clamp members.

7. The pill splitting apparatus as in claim 6, comprising a pair of secondary clamp members selectively extending through respective secondary apertures a selected distance into said interior area, each secondary clamp member having a first end configured to bear against the pill when the pill is positioned atop said pill tray.

8. The pill splitting apparatus as in claim 1, wherein:

said side wall of said base member defines a pair of secondary apertures opposed from one another and forming a secondary horizontal axis that is perpendicular to said primary horizontal axis; and said secondary horizontal axis is in a second horizontal plane that is upwardly displaced above said first horizontal plane.

9. The pill splitting apparatus as in claim 8, wherein each respective secondary clamp member includes a surface having a plurality of spaced apart measurement indicia that helps accurately position the pill being held securely between said pair of primary clamp members.

10. The pill splitting apparatus as in claim 1, wherein said cutting platform includes a top surface having a plurality of measurement indicia to aid a user in centering the pill prior to splitting it.

11. The pill splitting apparatus as in claim 10, wherein:

said side wall of said compression portion defines a cutout in communication with said open bottom and extending toward said compression plate; and said framework includes a flange having a configuration complementary to said cutout such that said cutting portion is slidably coupled to said compression portion in a friction fit arrangement.

12. The pill splitting apparatus as in claim 11, wherein:

a plurality of nubs are spaced apart on a lower surface of said compression plate;

each flange defines a plurality of recesses correspondingly configured to selectively engage respective nubs of said compression plate in a friction fit and selectively removable arrangement.

13. The pill splitting apparatus as in claim 11, wherein each flange includes an L-shaped configuration having a side section selectively mating with a respective cutout and a top section defining said recesses selectively mating with respective nubs.

14. The pill splitting apparatus as in claim 10, wherein:

said side wall of said compression portion defines a plurality of cutouts in communication with said open bottom and extending toward said compression plate; and said framework includes a plurality of flanges, each flange having a configuration complementary to a respective cutout such that said cutting portion is slidably coupled to said compression portion in a friction fit arrangement.

15. The pill splitting apparatus as in claim 10, wherein said cutting portion is selectively situated in said interior space of said compression portion via said open bottom.

16. The pill splitting apparatus as in claim 10, wherein said at least one blade includes a pair of blades situated in a crisscross pattern so as to split the pill into four pieces.

17. The pill splitting apparatus as in claim 10, wherein said at least one blade includes three blades situated in a spaced apart configuration so as to split the pill into six pieces.

18. The pill splitting apparatus as in claim 10, wherein said at least one blade includes four blades situated in a spaced apart configuration so as to split the pill into eight pieces.

19. The pill splitting apparatus as in claim 10, wherein said cutting portion having a particular blade quantity or configuration is interchangeable with another cutting portion having another blade quantity or configuration.

20. The pill splitting apparatus as in claim 1, wherein said plunger assembly includes:

a compression portion including said compression plate and having a side wall depending from said compression plate that defines an interior space and an open bottom allowing access to said interior space; and a cutting portion having a framework removably coupled to said side wall of said compression portion and said at least one blade is coupled to said framework.

21. The pill splitting apparatus as in claim 1, wherein said compression plate includes a diameter that is larger than a diameter of said side wall depending therefrom and larger than a diameter of said continuous side wall of said base so as to form a handle so the user will be easily able to pull the plunger assembly out.

22. The pill splitting apparatus as in claim 1, wherein said plunger assembly includes:

a compression portion including said compression plate and having a side wall depending from said compression plate that defines an interior space and an open bottom allowing access to said interior space;

a cutting portion having a framework removably coupled to said side wall of said compression portion and said at least one blade is coupled to said framework;

wherein:

said side wall of said compression portion defines a plurality of cutouts in communication with said open bottom and extending toward said compression plate;

said framework includes a plurality of flanges, each flange having a configuration complementary to a respective cutout such that said cutting portion is slidably coupled to said compression portion in a friction fit arrangement;

a plurality of nubs are spaced apart on a lower surface of said compression plate;

each flange defines a plurality of recesses correspondingly configured to selectively engage respective nubs of said compression plate in a friction fit and selectively removable arrangement.

* * * * *